United States Patent [19]

Hirsch

[11] Patent Number: 5,063,412

[45] Date of Patent: Nov. 5, 1991

[54] DEVELOPMENT APPARATUS USING AN ELECTROMAGNET TO PREVENT DEVELOPMENT IN THE NON-OPERATIVE MODE

[75] Inventor: Mark J. Hirsch, Fairport, N.Y.

[73] Assignee: Xerox Corporation, Stamford, Conn.

[21] Appl. No.: 588,406

[22] Filed: Sep. 26, 1990

[51] Int. Cl.[5] ..... G03G 15/06

[52] U.S. Cl. ..... 355/259; 118/656; 118/658; 355/251; 430/122

[58] Field of Search ..... 355/246, 251, 253, 259, 355/245; 118/656, 657, 658; 430/122

[56] References Cited

U.S. PATENT DOCUMENTS

| | | | |
|---|---|---|---|
| 3,257,224 | 6/1966 | Jons et al. | 117/17.5 |
| 4,465,356 | 8/1984 | Joseph et al. | 118/658 X |
| 4,499,851 | 2/1985 | Kopko et al. | 118/658 |
| 4,537,494 | 8/1985 | Lubinsky et al. | 355/251 |
| 4,565,437 | 1/1986 | Lubinsky | 355/251 |
| 4,641,946 | 2/1987 | Forbes, II | 355/251 |

*Primary Examiner*—A. T. Grimley

*Assistant Examiner*—Christopher Horgan

[57] ABSTRACT

An apparatus which develops a latent image recorded on a photoconductive member with developer material. The developer material is transported by a tubular member into a development zone. Developer material is attracted to the surface of the tubular member by a stationary magnet. In the operative mode, a weak magnetic field is formed in the development zone which releases the developer material from the surface of the tubular member so that the latent image attracts the developer material thereto. In the non-operative mode, an electromagnet is energized to decrease the magnetic field gradients in the development zone so as to decrease the tangential force on the surface of the tubular member preventing the developer material from moving therewith. The tubular member rotates in the opposite direction to the direction of rotation during development. With the electromagnet energized, the developer material moves with the tubular member away from the development zone to position the bare surface of the tubular member in the developing zone to prevent development of the latent image.

10 Claims, 2 Drawing Sheets

DEVELOPMENT APPARATUS USING AN ELECTROMAGNET TO PREVENT DEVELOPMENT IN THE NON-OPERATIVE MODE

This invention relates generally to an electrophotographic printing machine, and more particularly concerns a developer unit adapted to transport developer material into a development zone, in an operative mode, and remove developer material from the development zone in the non-operative mode.

In the process of electrophotographic printing, a photoconductive surface is charged to a substantially uniform potential. The photoconductive surface is image wise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a copy sheet and permanently affixed thereto. The foregoing generally describes a typical mono-color electrophotographic copying machine.

Recently, electrophotographic printing machines have been developed which produce highlight color copies. A typical highlight color printing machine records successive electrostatic latent images on the photoconductive surface. When combined, these electrostatic latent images form a total latent image corresponding to the entire original document being reproduced. One latent image is usually developed with black toner particles. The other latent image is developed with color highlighting toner particles, e.g. red toner particles. These developed toner images are transferred to the copy sheet to form the color highlighted copy. A color highlight printing machine of this type is a two pass machine. Single pass highlight color printing machines using tri-level printing have also been developed. Tri-level electrophotographic printing is described in detail in U.S. Pat. No. 4,078,929. As described in this patent, the latent image is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

In tri-level electrophotographic printing, the charge on the photoconductive surface is divided in three, rather than two, ways as is the case in mono-color printing. The photoconductive surface is charged, typically to about 900 volts. It is exposed image wise, such that one image corresponding to the charged image areas remains at the full potential of 900 volts. The other image, which corresponds to the discharged image areas, is exposed to discharge the photoconductive surface to its residual potential of typically about 100 volts. The background areas are exposed to reduce the photoconductive surface potential to about halfway between the charged and discharged potentials, (typically about 500 volts). The developer unit arranged to develop the charged image areas, is typically biased to about 600 volts, and the developer unit, arranged to develop the discharged image areas, is biased to about 400 volts. The single pass nature of this system dictates that the electrostatic latent image pass through the developer units in a serial fashion.

In a highlight color printing machine, it is frequently desirable to produce a mono-color copy. In addition, highlight color developer units may be interchanged in order to change the color of the highlight color. In both of these cases, the flow of developer material must be completely stopped. The developer rollers used in the developer units typically generate a weak magnetic field in the center of the development zone so that the developer material will be readily released from the developer roller and agitated adjacent the latent image recorded on the photoconductive belt. This developer material is then attracted to the latent image. In order to stop the flow of developer material, the forward rotation of the developer roller is stopped and reversed for a period of time. In this way, developer material is transported away from the development zone and, since there are no pickup magnets on the reverse side of the developer roller, a bare roller surface should be rotated into the development zone. However, it has been found that developer material remains on the developer roller in the development zone even after the developer roller has rotated for the specified period of time in the reverse direction. This is due to the magnetic forces on the developer material produced by the gradients in the magnetic field. There are components of the magnetic force along the field gradient from low field regions to high field regions. These magnetic forces are tangential to the surface of the developer roller and cause developer material to be trapped on the downstream side of the development zone. This developer material is prevented from moving to the low field center portion of the development zone by the magnetic gradient force. As the developer roller rotates, the developer material remains in the same relative position relative to the magnets in the core. This reluctance of the developer material to move through the development zone occurs only for relatively isolated granules of developer material. When the developer roller rotates in the forward direction, the developer material is prevented from remaining in the same position relative to the magnet by the mass of developer material on the developer roller. Thus, it has been found that reversing the direction of rotation of the developer roller does not necessarily remove the developer material from the development zone. The following disclosure appears to be relevant:

U.S. Pat. No. 3,257,224; patentee: Jons et al.; issued: June 21, 1966.

The relevant portions of the foregoing patent may be briefly summarized as follows:

U.S. Pat. No. 3,257,224 describes an electromagnetically excited roller which transports developer material to a photoconductive member.

In accordance with one aspect of the present invention, there is provided an apparatus for developing a latent image recorded on a member with developer material. The apparatus includes means for transporting the developer material into a development zone, in the operative mode, and removing developer material from the development zone, in the non-operative mode, so as to develop the latent image recorded on the member with developer material in the operative mode and prevent development thereof in the non-operative mode. Means are provided for attracting the developer material to the transporting means. Means, operable in the non-operative mode, change the attraction between the developer material and the transporting means so that the developer material moves with the transporting means away from the development zone.

Pursuant to another aspect of the present invention, there is provided an electrophotographic printing machine adapted to have an electrostatic latent image recorded on a photoconductive member developed with developer material. The printing machine includes means for transporting the developer material into a development zone, in the operative mode, and removing developer material from the development zone, in the non-operative mode, so as to develop the latent image recorded on the member with developer material in the operative mode and prevent development thereof in the non-operative mode. Means are provided for attracting the developer material to the transporting means. Means, operable in the non-operative mode, change the attraction between the developer material and the transporting means so that the developer material moves with the transporting means away from the development zone.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternative, modifications, and equivalents as may be included within the spirit and scope of the invention as defined by the appended claims.

Figure 1:
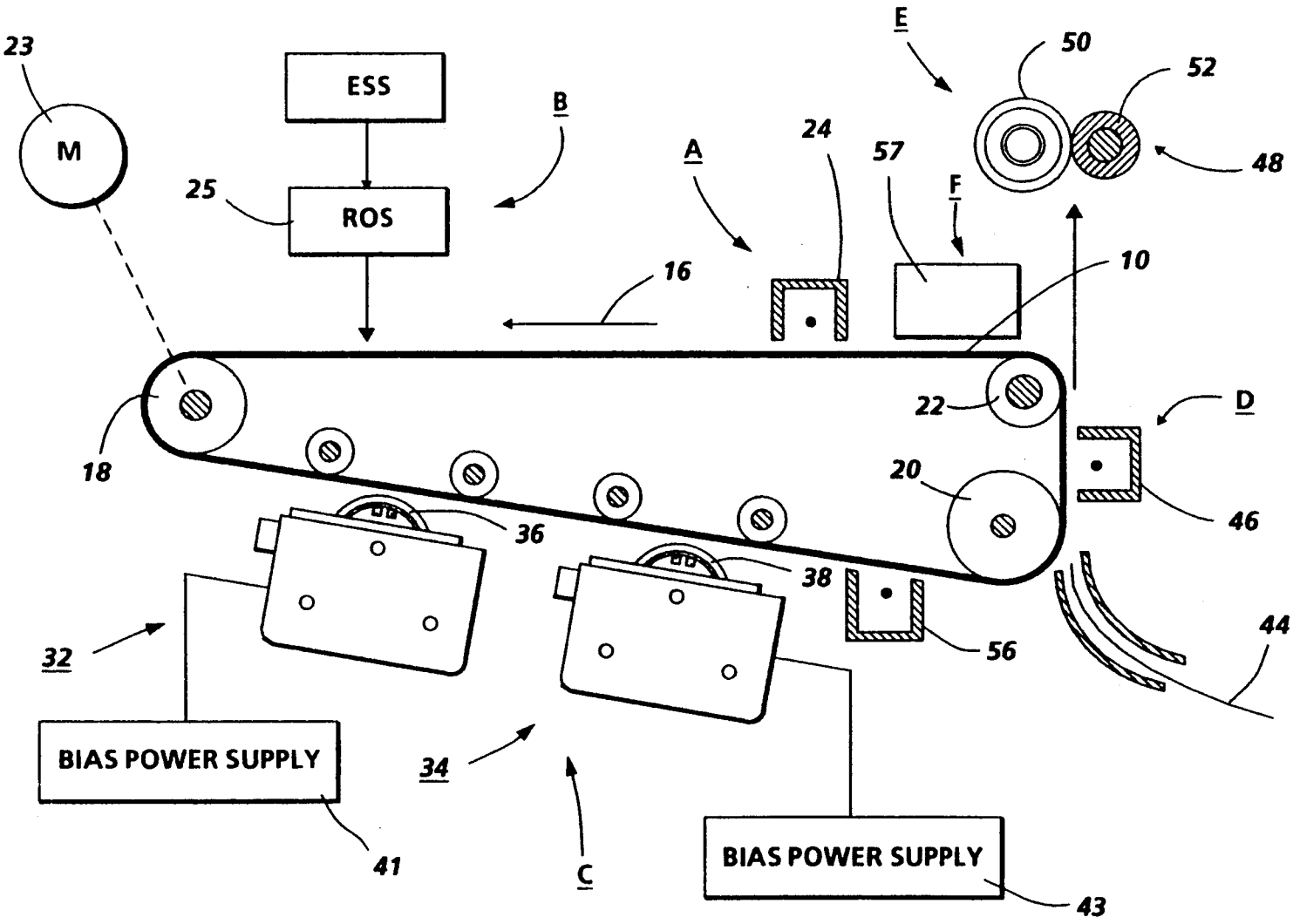
FIG. 1 is a schematic elevational view of an illustrative electrophotographic printing machine incorporating the developer units of the present invention therein.

For a general understanding of the illustrative electrophotographic printing machine incorporating the features of the present invention therein, reference is made to the drawings. In the drawings, like reference numerals have been used throughout to designate identical elements. FIG. 1 schematically depicts the various components of the electrophotographic printing machine incorporating the developer unit of the present invention therein. Although the developer unit of the present invention is particularly well adapted for use in the illustrative printing machine, it will become evident that this developer unit is equally well suited for use in a wide variety of printing machines and is not necessarily limited in its application to the particular embodiment shown herein.

Referring now to FIG. 1, the electrophotographic printing machine employs a belt 10, i.e. a charge retentive member, having a photoconductive surface deposited on a conductive substrate. Preferably, the photoconductive surface is made from a selenium alloy with the conductive substrate being made preferably from an electrically grounded aluminum alloy. Belt 10 moves in the direction of arrow 16 to advance successive portions thereof sequentially through the various processing stations disposed about the path of movement thereof. Belt 10 is entrained about drive roller 18, tensioning roller 20 and stripping roller 22. Motor 23 rotates roller 18 to advance belt 10 in the direction of arrow 16. Roller 18 is coupled to motor 23 by suitable means such as a belt drive.

Initially successive portions of belt 10 pass through charging station A. At charging station A, a corona generating device such as a scorotron, corotron or dicorotron indicated generally by the reference numeral 24, charges belt 10 to a selectively high uniform positive or negative potential. Preferably, charging is negative. Any suitable control system well known in the art, may be employed for controlling the corona generating device 24.

Next, the charged portions of the photoconductive surface are advanced through exposure station B. At exposure station B, the uniformly charged photoconductive surface is exposed to a laser based output scanning device 25 which causes the charged portion of the photoconductive belt 10 to be selectively discharged in accordance with the output from the scanning device. Preferably the scanning device is a three level laser Raster Output Scanner (ROS). The photoconductive surface, which is initially charged to a high charged potential, is discharged image wise in the background (white) image areas and to near zero or ground potential in the highlight (i.e. non-black) color parts of the image.

After exposure, belt 10 advances the latent images to development station C. Development station C includes two developer units, indicated generally by the reference numerals 32 and 34, respectively. Each developer unit includes a magnetic brush developer roller 36 and 38, respectively. Developer rollers 36 and 38 transport brushes of developer material comprising magnetic carrier granules and toner particles into contact with belt 10. Appropriate developer biasing is accomplished via power supplies 41 and 43 electrically connected to respective developer units 32 and 34.

Color discrimination in the development of the electrostatic latent image is achieved by moving the latent image recorded on the photoconductive surface past developer units 32 and 34 in a single pass with the magnetic brush rolls 36 and 38 electrically biased to voltages which are offset from the background voltage, the direction of offset depending on the polarity of toner in the housing. The first developer unit 32, in the direction of movement of belt 10 as indicated by arrow 16, develops the discharged image areas of the photoconductive surface. This developer unit contains red developer material having triboelectric properties such that the red toner is driven to the discharged image areas of the latent image by the electrostatic field between the photoconductive surface and the electrically biased developer rolls. Conversely, the second developer unit 34, in the direction of movement of belt 10 as indicated by arrow 16, develops the highly charged image areas of the latent image. This developer unit contains black developer material having a triboelectric charge such that the black toner is urged towards highly charged areas of the latent image by the electrostatic field existing between the photoconductive surface and the electrically biased developer rolls in the second developer unit.

In the operative mode, a weak magnetic field is generated in the development zone releasing the developer material from the developer roller and permitting the latent image to more readily attract the toner particles thereto. In contradistinction, in the non-operative mode, the magnetic field is changed and the developer roller rotates for a specified period of time in a direction opposite to the normal direction of rotation during development. The magnetic field gradient is reduced so as to reduce the tangential forces opposing the movement of developer material with the developer roller. In this way, the developer material is moved away from the development zone to position a bare developer roller surface thereat. Developer units 32 and 34 are identical to one another, the only difference being the color of the toner particles contained therein. Inasmuch as the developer units are identical, only developer unit 32 will be described hereinafter in greater detail with reference to FIGS. 2 and 3.

By way of example, the carrier in developer unit 32 consists of 100 to 150 micron Hoeganese steel core coated (by weight) with 1.2% a methyl terpolymer with 20%, by weight of carbon black dispersed therein. The toner is made up (by weight) of 85% PLIOLITE (Trademark of Goodyear Tire and Rubber Company), 13.4% of a master batch of 1:1 litho scarlet pigment-/negative charging styrene n-butyl methacralate polymer, 0.56% magenta and hostaperm pink pigments predispersed in polymer, 1% dimethhyl di-stearyl ammonium methyl sulfate, 0.5% aerosil, and 0.1% zinc stearate. When this developer is mixed to a 2.5% (by weight) toner concentration and rolled milled for 10 minutes, the toner's tribo, as measure by placing the developer in a screened faraday cage and removing the toner with an air stream, is a negative 11 micro-coulombs/gram. The black carrier in developer unit 34 consists of 100 to 150 micron Hoeganese steel core coated (by weight) with 0.4% of a positive charging co-polymer (chlorotrifloro-ethylene+polyvinyl chloride) with 20, by weight of VULCAN (Trademark of Cabot Corporation) carbon black dispersed therein. The composition of the black toner is 92% styrene n-butyl methacralate polymer, 6% carbon B REGAL 330 (Trademark of Cabot Corporation) carbon black, and 2% cetyl pyridinium chloride. The tribo of the black toner as determined by the roll mill and faraday cage method is a positive 20 micro-coulombs/gram. The entire voltage difference is shared equally between the highly charged image areas and the discharged image areas. This corresponds to approximately 800 volts (if a realistic charging level of 900 volts and a residual discharge voltage of 100 volts are assumed). Allowing an additional 100 volts for the cleaning fields in each development housing means an actual development contrast voltage for highly charged image areas of approximately 300 volts and an approximately equal amount for the discharged image areas. In the foregoing case, 300 volts of contrast voltage is provided by electrically biasing the first developer unit, which develops the discharged image areas with non-black, negatively charged toner, to a voltage level of approximately 400 volts and the second developer unit, which develops the highly charged image areas with positively charged black toner, to a voltage level of 600 volts.

A sheet of support material 44 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from the stack into a chute which directs the advancing sheet of support material into contact with the photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 46 which sprays ions of a suitable polarity onto the backside of sheet 44. This attracts substantially simultaneously the black and non-black portions of the toner powder image from the belt 10 to sheet 44. After transfer, the sheet continues to move onto a conveyor (not shown) which advances the sheet to fusing station E.

Fusing station E includes a fuser assembly, indicated generally by the reference numeral 48, which permanently affixes the transferred powder images to sheet 44. Preferably, fuser assembly 48 has a heated fuser roller 50 and back-up roller 52. Sheet 44 passes between fuser roller 50 and back-up roller 52 with the toner powder images contacting fuser roller 50. In this manner, the toner powder images are permanently affixed to sheet 44. After fusing, sheet 44 is advanced to a catch tray for subsequent removal from the printing machine by the operator.

After the sheet of support material is separated from the photoconductive surface of belt 10, the residual toner particles carried by the non-image areas on the photoconductive surface are removed therefrom. These particles are removed at cleaning station F. A magnetic brush cleaner unit 57 is disposed at the cleaning station F. The cleaner unit has a conventional magnetic brush roll structure for causing carrier particles in the cleaner housing to form a brush-like orientation relative to the roll structure and the photoconductive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

It is believed that the foregoing description is sufficient for purposes of the present application to illustrate the general operation of an electrophotographic printing machine incorporating the developer units of the present invention therein.

Figure 2:
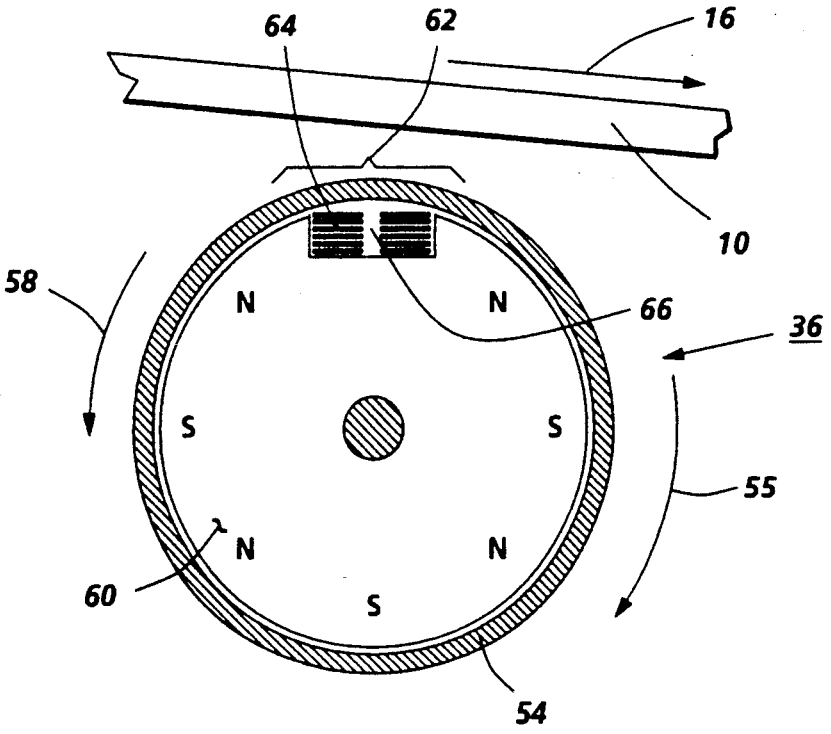
FIG. 2 is an elevational view showing the developer roller used in the developer units of the FIG. 1 printing machine.

Referring now to the specific subject matter of the present invention, FIG. 2, shows developer roller 36 of developer unit 32 in greater detail. Developer roller 36 advances the developer material into contact with the electrostatic latent image recorded on the photoconductive surface of belt 10. Developer roller 36 is located in the sump of the housing of developer unit 32 for advancing developer material to the electrostatic latent image recorded on photoconductive belt 10. A trim bar regulates the thickness of the developer pile height on developer roller 36. Developer roller 36 includes a non-magnetic tubular member 54 preferably made from aluminum having the exterior surface thereof roughened. In the operative mode, tubular member 54 rotates in the direction of arrow 55. When developer unit 34 is in the non-operative mode, tubular member 54 rotates in the direction of arrow 58. In the non-operative mode, tubular member 54 rotates through a preselected angle in the direction of arrow 58, i.e. in reverse direction to the normal direction of rotation during development. A magnet 60 or a set of individual magnets is mounted interiorly of tubular member 54 and spaced therefrom. Magnet 60 is stationary and positioned to attract the developer material to the exterior circumferential surface of tubular member 54. In this way, as tubular member 54 rotates in the direction of arrow 55, developer material is attracted to the exterior circumferential surface thereof and moved therewith into development zone 62. An electromagnet 64 is mounted in slot 66 of magnet 60 interiorly of tubular member 54 opposed from development zone 62. In the operative mode, i.e. when tubular member 54 rotates in the direction of arrow 55, electromagnet 64 is de-energized. In the non-operative mode, i.e. when tubular member 54 rotates through a selected angle in the direction of arrow 58, electromagnet 64 is energized. When the electromagnet is de-energized, the radial magnetic field at the entrance and exit to development zone 62 is about 600 gauss with the radial magnetic field in the center of the development zone being about 325 gauss. In order to prevent development, tubular member 54 rotates in the direction of arrow 58 and electromagnet 64 is energized. When electromagnet is energized, the magnetic field gradients in the development zone are reduced. These field gradients produced forces on the developer material in a direction tangential to the surface of the developer roller. These tangential forces prevented the developer material from moving with the developer roller away from the development zone. Thus, the tangential forces prevented clearing of the developer material from the development zone. Energization of the electromagnet reduces the magnetic field gradients and reduces these tangential forces. By way of example, with a current of about 3.2 amps, the radial magnetic field in the center of development zone 62 increases by about 90 gauss. Tubular member 54 rotates in the direction of arrow 58 for a period of about 0.7 second through an angle of about 270°. The developer material moves in unison with tubular member 54 away from development zone 62 when electromagnet 64 is energized with a current of about 5.0 amps so that the bare surface of tubular member 54 is in development zone 62.

Figure 3:
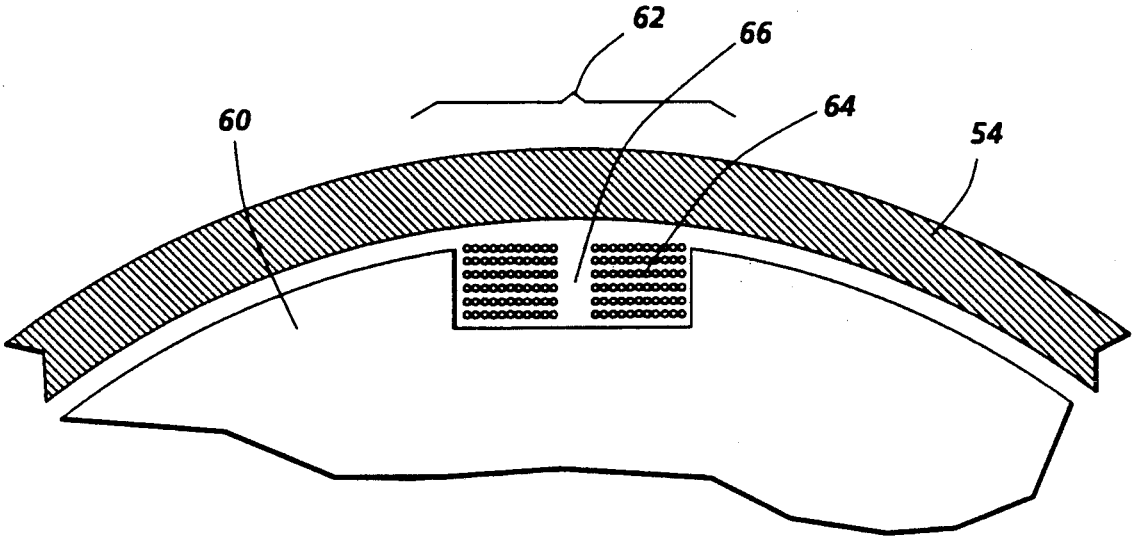
FIG. 3 is an enlarged, fragmentary elevational view of the FIG. 2 developer roller.

Referring now to FIG. 3, electromagnet 64 is mounted in slot 66 in magnet 60 opposed from development zone 62. Preferably, electromagnet 64 is a coil having about 65 turns of No. 30 gauge enameled wire. Slot 66 is about 3.5 millimeters deep and about 8.0 millimeters wide and extends the length of magnet 60.

In recapitulation, the developer unit of the present invention employs a developer roller having an electromagnet mounted in a magnet and positioned opposed from the development zone. In the operative mode, the electromagnet is de-energized and the magnet exert a weak magnetic field in the development zone permitting the centrifugal and shearing forces exerted on the developer material to release the developer material from the developer roller and agitate the toner particles so that the toner particles are attracted to the latent image, thereby developing the latent image. In the non-operative mode, the electromagnet is energized decreasing the magnetic field gradient and the corresponding tangential force so that the developer material moves with the developer roller away from the development zone so as to prevent development of the latent image.

It is, therefore, apparent that there has been provided in accordance with the present invention, a developer unit that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for developing a latent image recorded on a member with developer material, including:

means for transporting the developer material into a development zone, in the operative mode, and removing developer material from the development zone, in the non-operative mode, so as to develop the latent image recorded on the member with developer material in the operative mode and prevent development thereof in the non-operative mode;

means for attracting the developer material to said transporting means, said attracting means includes a magnet operatively associated with said transporting means to attract developer material thereto, said magnet being adapted to generate a weak magnetic field in the development zone; and means, operable in the non-operative mode, for changing the attraction in the development zone between the developer material and said transporting means so that the developer material moves with said transporting means away from the development zone, said changing means includes an electromagnet adapted to be energized in the non-operative mode to decrease the magnet field gradients in the development zone.

2. An apparatus according to claim 1, wherein said transporting means includes a rotatably mounted tubular member having said magnet disposed interiorly thereof and spaced therefrom.

3. An apparatus according to claim 2, wherein said magnet has a slot opposed from the development zone with said electromagnet mounted therein.

4. An apparatus according to claim 3, further including means for rotating said tubular member in a first direction when in the operative mode and in a second direction, opposed to the first direction, when in the non-operative mode.

5. An apparatus according to claim 4, wherein said magnet is stationary.

6. An electrophotographic printing machine adapted to have an electrostatic latent image recorded on a photoconductive member developed with developer material, wherein the improvement includes:

means for transporting the developer material into a development zone, in the operative mode, and removing developer material from the development zone, in the non-operative mode, so as to develop the latent image recorded on the member with developer material in the operative mode and prevent development thereof in the non-operative mode;

means for attracting the developer material to said transporting means, said attracting means includes a magnet operatively associated with said transporting means to attract developer material thereto, said magnet being adapted to generate a weak magnetic field in the development zone; and means, operable in the non-operative mode, for changing the attraction in the development zone between the developer material and said transporting means so that the developer material moves with said transporting means away from the development zone, said changing means includes an electromagnet adapted to be energized in the non-operative mode to decrease the magnet field gradients in the development zone.

7. A printing machine according to claim 6, wherein said transporting means includes a rotatably mounted tubular member having said magnet disposed interiorly thereof and spaced therefrom.

8. A printing machine according to claim 7, wherein said magnet has a slot opposed from the development zone with said electromagnet mounted therein.

9. A printing machine according to claim 8, further including means for rotating said tubular member in a first direction when in the operative mode and in a second direction, opposed to the first direction, when in the non-operative mode.

10. A printing machine according to claim 9, wherein said magnet is stationary.

* * * * *